United States Patent [19]

McGovern

[11] 4,147,345

[45] Apr. 3, 1979

[54] ROUND POOL TABLE

[76] Inventor: James R. McGovern, 205 E. 239 St., Bronx, N.Y. 10470

[21] Appl. No.: 787,627

[22] Filed: Jun. 1, 1977

[51] Int. Cl.[2] ..... A63D 15/00

[52] U.S. Cl. ..... 273/2; 273/3 A; 273/4 R; 273/9; 273/11 R; 273/12

[58] Field of Search ..... 273/2, 3 A, 3 B, 4 R, 273/4 A, 5 R, 5 A, 8, 9, 10, 11 R, 12, 14, 123 R, 126 R, 127 D

[56] References Cited

U.S. PATENT DOCUMENTS

| | | | |
|---|---|---|---|
| 296,677 | 4/1884 | Chasley | 273/8 |
| 740,012 | 9/1903 | Haskell | 273/4 A |
| 3,488,054 | 1/1970 | Brzoska | 273/11 R |
| 3,610,618 | 10/1971 | Wiggins | 273/5 A |
| 3,825,258 | 7/1974 | Frierman | 273/2 |
| 4,063,728 | 12/1977 | Zemanek | 273/4 R |

FOREIGN PATENT DOCUMENTS

| | | | |
|---|---|---|---|
| 252823 | 10/1912 | Fed. Rep. of Germany | 273/2 |
| 1603050 | 2/1971 | Fed. Rep. of Germany | 273/123 R |
| 897131 | 5/1944 | France | 273/9 |
| 2258207 | 8/1975 | France | 273/127 D |

*Primary Examiner*—Richard T. Stouffer

[57] ABSTRACT

A round pool table which has a flat playing surface rimmed by a "cushion" which consists of several rubber tipped segments, any three adjacent of which at option of a player can be raised to an upright position, thereby establishing a pocket.

1 Claim, 6 Drawing Figures

ROUND POOL TABLE

BRIEF SUMMARY OF THE INVENTION

This invention is a round pool table with a flat playing surface that is rimmed by a "cushion" which consists of several rubber tipped segments, any three adjacent of which at the option of a player can be raised to an upright (near vertical) position to establish a pocket to be used by an opponent, to shoot a ball into.

BRIEF DESCRIPTION OF THE SEVERAL VIEWS

DETAILED DESCRIPTION OF THE INVENTION

Figure 1:
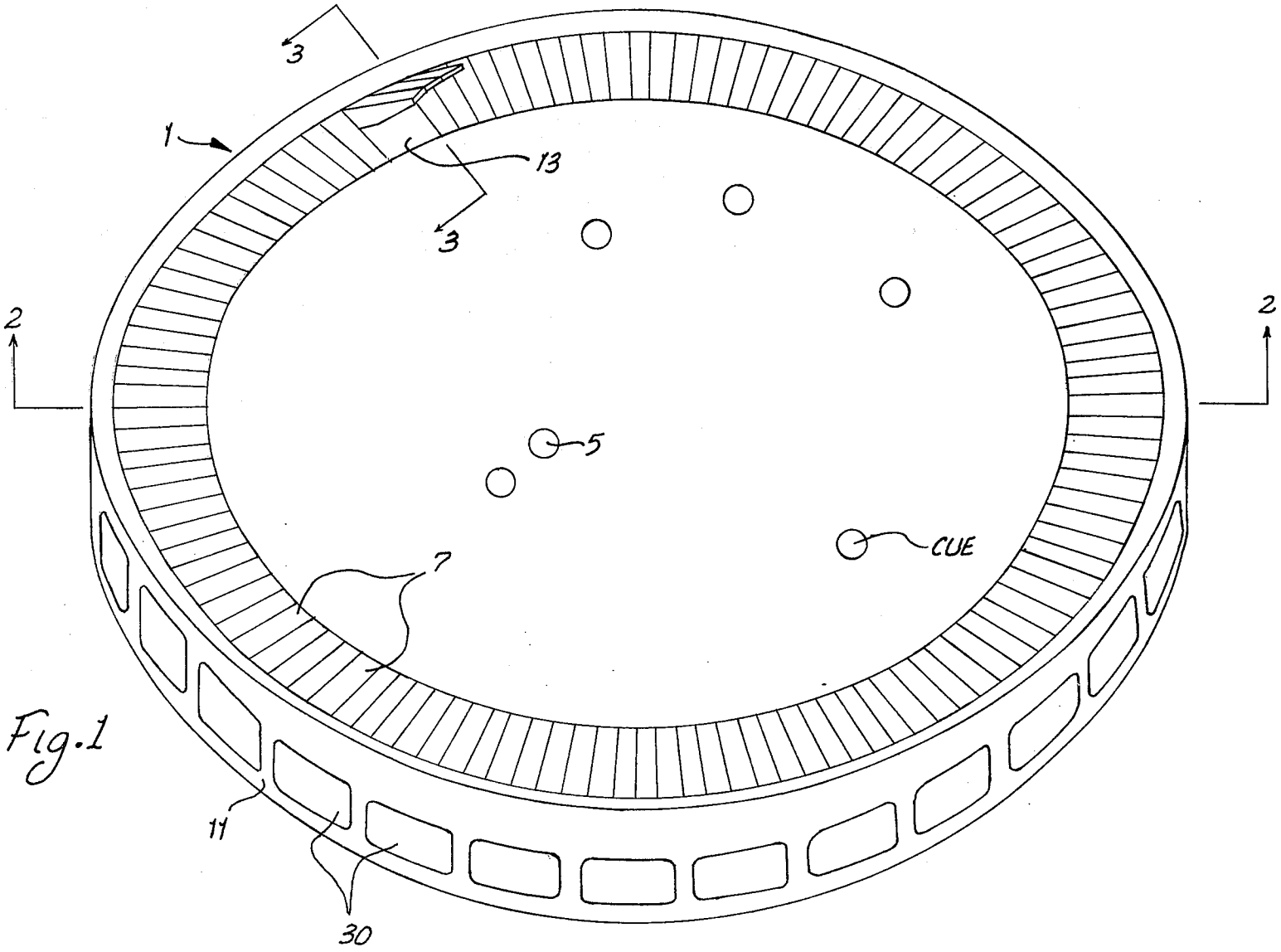
FIG. 1 is a perspective view of the invention which shows the several rubber tipped segments which form the cushion of the table, with three adjacent segments raised to establish a pocket. It also shows the ball retrieval ports in the table skirt.
Figure 2:
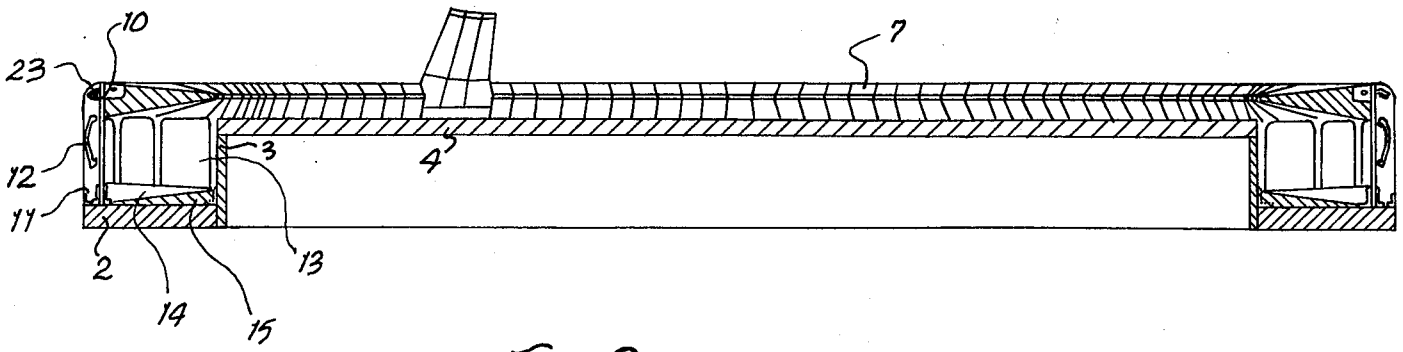
FIG. 2 is a cross section of the table taken along the line 2—2 of FIG. 1.
Figure 3:
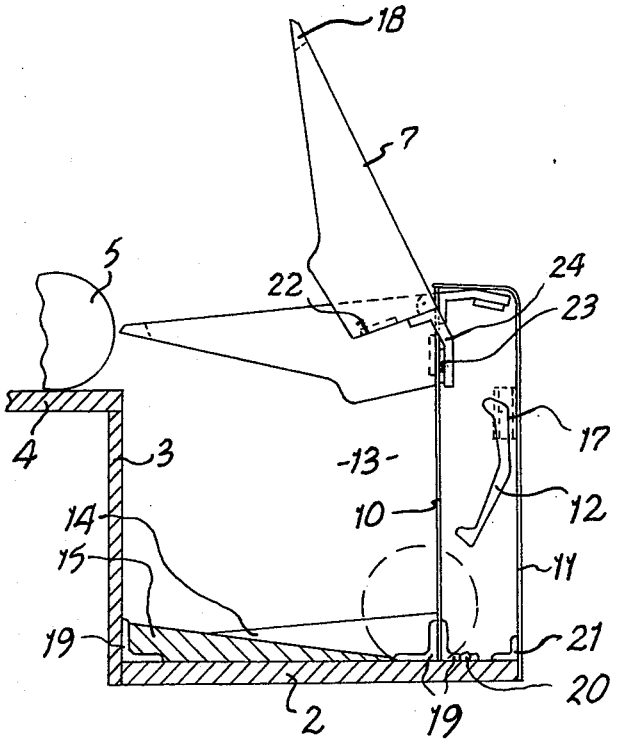
FIG. 3 is a cross section of a pocket taken along the line 3—3 of FIG. 1 that has been formed by raising three adjacent segments of a circular ring (the cushion of the table) and shows a trace of a ball drop.
Figure 4:
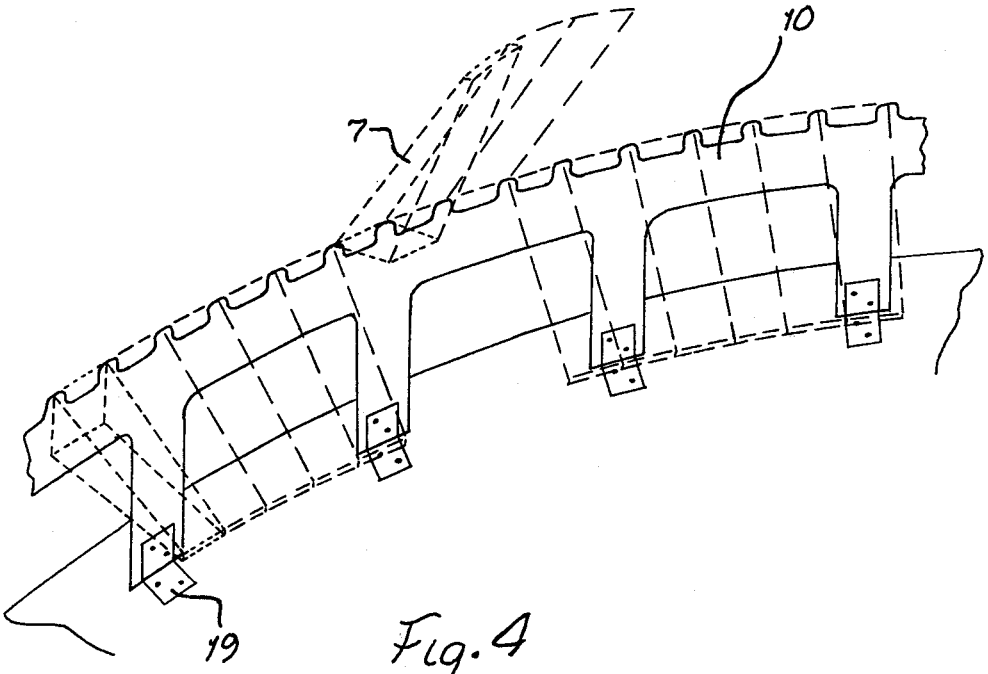
FIG. 4 is a perspective view of the structural member which supports the cushion segments and the table skirt.
Figure 5:
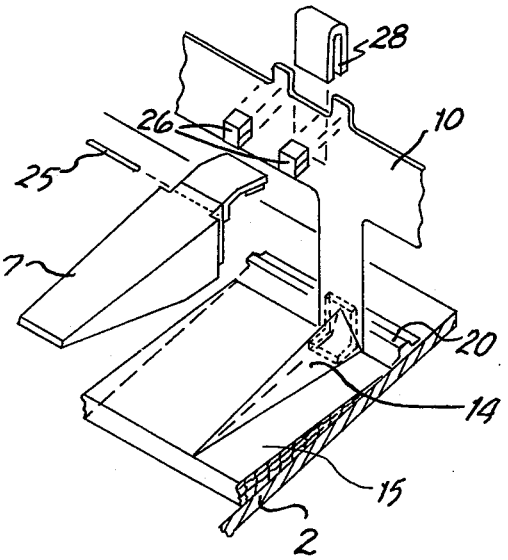
FIG. 5 is a perspective view of a cushion segment and its mounting blocks.
Figure 6:
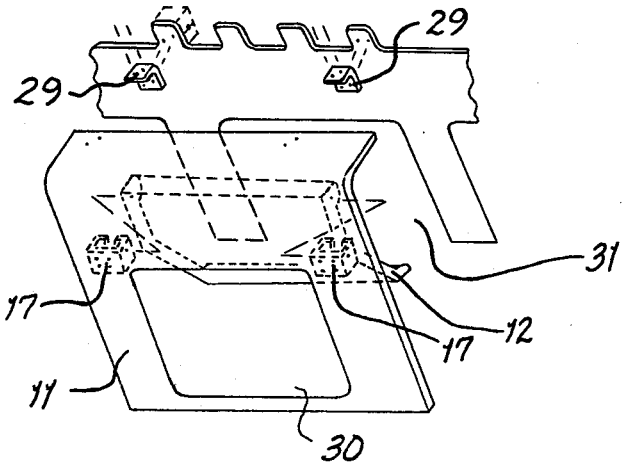
FIG. 6 is a perspective view of the table skirt and its mounting, a ball retrieval port, and a ball retainer and its mounting.

The manner of making and using the invention would be as follows: referring to FIGS. 1 through 6, to make a round pool table 1, provide a "washer shaped" ball drop area base 2 and within the inner circle of this base 2 mount a vertical "rim like" playing surface support 3—fasten the playing surface support 3 to the ball drop area base 2 by angles 19—now place the playing surface 4, a circular plane which could be covered with cloth on its top surface, on the vertical support 3 and fasten it thereto.

Spaced from the outer edge of the "washer shaped" ball drop area base 2 place a plastic structural member 10—a vertical circular shape member 10 with leg like extensions projecting downward in its lower portion, and "tab like" extensions projecting upwards in its upper portion.

The structural member 10 is secured to the ball drop area base 2 by each of its leg extensions being held between back to back L shaped angles 19 so that when it is in place it presents a rigid support on which to mount the segments 7 that form the cushion of the table 1.

Next place a flat metal inverted U shaped clip 28 between each tab of the structural member 10 to serve as a base of attraction for magnets 22 and 23 of each cushion segment 7.

The next sequential step in making the invention would be fastening the mounting blocks 26, which are the means of hinging the cushion segments onto the structural member 10, however let us first consider the construction and function of the cushion segment 7.

A cushion segment 7 is wedge like in shape from its top view and its side view. It could probably be made from a block of wood and possibly molded from plastic.

Its narrow thinner portion has a rubber tip 18, and points toward the center of the playing surface 4 area while its wide heavy portion points away from the center of the playing surface 4 area. There is a horizontal pin 25 projecting out of each side of each segment 7 so that each segment 7 can be held by mounting blocks 26 and be moved up and down in a hinged manner. A modified L shaped bracket, 24, with a small magnet 23 fastened to the underside of its horizontal leg is fastened by its vertical leg to the back of each cushion segment 7 and there is a small magnet 22 imbedded in the back of each cushion segment 7 so that you have a cushion segment 7 that is held in a horizontal position by its back magnets 22 attraction to the inner face of the inverted clip 28, or moved in a hinged manner to a near vertical position and held in that position by its bracket magnets 23 attraction to the outer face of the inverted clip 28.

There is a mounting block 26 fastened to the inner face of each tab of the structural member 10. A mounting block consists of a piece of material that is generally square, and is fastened to the structural member 10.

Now, on top of the ball drop area base 2, secure a wooden or plastic surface 15 that will extend from the vertical rim 3 to the structural member 10 so that when a ball 5 is sunk it will roll outward toward the ball retainer lip 20.

The ball retainer lip 20 which would resemble a molding strip could be made of plastic. It would be attached to the ball drop area base 2 just outside the circle formed by the structural member 10. The lip will serve to stop a ball's roll. It is a point of rest from which a ball 5 can be easily retrieved.

A triangular shaped deflector 14 would then be attached to the inclined surface 15. It should be butted against the inner support angle 19 of each structural member 10 leg and extend up the inclined surface 15. Its purpose would be to prevent a sunk ball 5 from becoming inaccessable by coming to rest behind a leg of the structural member 10.

The skirt 11 of the table 1 is a continuous covering which encloses the ball drop area 13 of the table 1. It could possibly be made of plastic. There are cut-outs (outer ball retrieval ports 30) in the vertical portion of the skirt and it is fastened at the top by support angles 29 to the outer face of the structural member 10 tabs, and at the bottom by support angles 21 on the top surface of the ball drop area base 2.

On the inner face side of the table skirt 11 opposite each outer ball retrieval port 30 there is a pendulum like ball retainer 12 which is hung on U shaped brackets 17 which are mounted on the inner face of the table skirt 11. The ball retainer 12 can be moved in an inward, toward the center of the table, direction only. Its purpose is to serve as a block of the outer ball retrieval port 30 on a hard shot, where the momentum of the ball 5 might carry it through the inner ball retrieval port 31 and through the outer ball retrieval port 30 if it were not stopped. After fastening the table skirt 11, the assembly of the invention would be complete.

USE OF THE INVENTION

The invention could be used by two people to play a game of pool. The sequence of a game would be as follows: all cushion segments 7 are placed in a horizontal (down) position—there is no pocket 13 at the break—the balls are racked (the inventor conceived the game as being played with five pool balls 5 and one cue ball) and broke.

After the break, the player who broke would then establish a pocket at an optional location by lifting three adjacent cushion segments 7 to an upright (near vertical) position, and his opponent would then shoot.

When a shot is sunk the ball 5 drops into the pocket 13, rolls down the inclined surface 15, is deflected if need be by the triangular deflector 14, and comes to a point of rest against the ball retainer lip 20.

When all the balls 5 have been sunk they are retrieved by reaching through the outer ball retrieval port 30, pushing the pendulum like ball retainer 12 out of the way, extending the hand into the inner ball retrieval port 31, grasping each ball 5 and lifting it out, and placing it on the playing surface 4 of the table 1.

I claim:

1. A round pool table which comprises a circular playing surface, a vertically upstanding circular structural member completely encircling said playing surface and said structural member being spaced apart by an annular ball drop area, said ball drop area being spaced below the level of said playing surface, a plurality of arcuate segments collectively arranged around the entire periphery of said playing surface, said arcuate segments being pivotally mounted to said structural member, each of said segments being pivotable independently of each other segment from a horizontally disposed position overlying said ball drop area and forming a cushion for said playing surface to a vertically disposed position forming a pocket for a ball on said playing surface, said segments being so arranged to prevent a given ball from being projected directly from said playing surface into said ball drop area when all of said segments are horizontally disposed while at the same time being so arranged to permit said given ball to be projected directly from said playing surface into said ball drop area when at least a predetermined number of said segments are vertically disposed side-by-side.

* * * * *